US008192045B2

(12) United States Patent
Vazquez et al.

(10) Patent No.: US 8,192,045 B2
(45) Date of Patent: Jun. 5, 2012

(54) PORTABLE FLUORESCENT LIGHTING SYSTEM WITH LONG-LIFE HINGE MECHANISM

(75) Inventors: Alejandro Vazquez, Monrovia, CA (US); Frieder Hochheim, Los Angeles, CA (US)

(73) Assignee: Kino Flo, Inc., Burbank, CA (US)

( * ) Notice: Subject to any disclaimer, the term of this patent is extended or adjusted under 35 U.S.C. 154(b) by 257 days.

(21) Appl. No.: 12/784,442

(22) Filed: May 20, 2010

(65) Prior Publication Data

US 2011/0286209 A1 Nov. 24, 2011

(51) Int. Cl.
*F21V 21/00* (2006.01)

(52) U.S. Cl. ..... 362/217.13; 362/217.09; 362/217.11; 362/260

(58) Field of Classification Search ..... 362/217.08–217.17, 260
See application file for complete search history.

(56) References Cited

U.S. PATENT DOCUMENTS

| | | | |
|---|---|---|---|
| 3,582,123 | A | 6/1971 | Kyser |
| 3,712,978 | A | 1/1973 | Lowell |
| 5,132,885 | A | 7/1992 | Hocheim et al. |
| 2007/0247842 | A1 | 10/2007 | Zampini et al. |
| 2009/0103314 | A1 | 4/2009 | Hammer et al. |

*Primary Examiner* — Jason Moon Han

(74) *Attorney, Agent, or Firm* — Blakely, Sokoloff, Taylor & Zafman

(57) ABSTRACT

A hinge retaining mechanism for a fluorescent lighting system. A portable fluorescent lighting system which utilizes an extremely lightweight corrugated plastic panel made into 5 subpanels. At each end of the panel a U shaped channel is attached that forms the center panel and the opposing adjacent two panels into a trough or recessed pan. On each of the two remaining panels is attached another U shaped channel. Each of the U shaped channels includes a mechanism for supporting a high-tension mechanical hinge. The mechanical hinge is designed to float freely within the adjacent channel brackets. One part of the hinge is mechanically retained to the channel to prevent inadvertent removal of the hinge.

8 Claims, 9 Drawing Sheets

SECTION B-B

PORTABLE FLUORESCENT LIGHTING SYSTEM WITH LONG-LIFE HINGE MECHANISM

BACKGROUND OF THE INVENTION

1. Field of the Invention

This invention relates to a portable and lightweight fluorescent lighting system suitable for use in the field of photography, television and motion pictures utilizing fluorescent lamps.

2. Description of the Prior Art

U.S. Pat. No. 5,132,885 disclosed a portable fluorescent lighting system. This system comprised of 5 corrugated panels that formed the basis of a lighting fixture. The five panels were created from one piece of corrugated polypropylene plastic. The panels were established by removing two to three upright flutes and one skin of corrugation between each panel. The remaining material formed a living hinge joining the 5 panels. The ends of the panel contained a U channel that carried a flexible metal wire that acted as a retention mechanism for holding the orientation of the panels once they were positioned by the user. The lighting system became very popular in motion picture lighting applications. The hinge retention mechanism being made of flexible metal wire had a given life span due to metal fatigue. After the metal fatigue resulted in the failure of the wire it would have to be replaced. Improvements were made along the way in which the flexible wire was encased in a flexible metal shield. This shield prevented sharp bends in the wire that would lead to premature wire fatigue and failure and thusly extended the life span of the wire.

Attempts at improving on the wire retention mechanism were challenging in that the panels do not pivot on a central point. Instead they pivot from one side of the living hinge. The original wire retainer concept was very low cost and very light weight. Applying conventional hinges to the fixture design never worked due to the pivot centers always being off center. Replacing the living hinge with a conventional hinge dramatically increased the cost and weight of the fixture as well as assembly costs. There was never a viable solution to improving on the hinge.

Various attempts have been made by others to construct a low maintenance hinge retention mechanism for this style of fixture. Film Gear, a Chinese manufacturer constructed a mechanism that comprised many parts that added weight and was costly to construct. They relied on a complex series of broad shallow U channels in which conventional hinge elements would slide back and forth under tension. The panels relied on the tension of the sliding hinge elements binding with the edges of the U channel. Over time this tension would lessen and fail to support the panels. The high assembly cost, weight and limited mobility of the mechanism were not considered a product enhancement. The performance of this hinge over time did not live up to the claims of superiority. When it required replacement the process was also labor intensive. This approach never found market acceptance.

SUMMARY OF THE INVENTION

The present invention addresses the issue of hinge wire maintenance by presenting a low cost high-tension mechanical retention hinge while not adding weight. The hinge construction takes into account the off center pivot point of the panels. It is designed for robust manipulation, low cost, ease of manufacturing and long tension life. It is designed for easy field replacement should the necessity ever arise.

The new design also allows for mounting pads to hold accessory honeycomb louvers used in directing the light as well as an accessory that blocks light from exiting the ends of the fixture.

This invention entails a lighting fixture having 5 panels. The invention has four primary elements:

1. premolded central panel U channel with accessory holder;
2. premolded outer subpanel U channel;
3. premolded high tension retainer hinge;
4. flexible light shield.

A premolded central U channel made of high impact plastic is mechanically fastened to the central and two secondary subpanel elements. This form is common to the opposing end of the fixture. The molded channels retain the three panels in a rigid trough configuration. The central panel U channel is configured to hold a lamp harness strain relief. The strain relief mechanism uses a ¼ turn fastener such as manufactured by Southco and a cable tie that wraps around the harness cable. The central panel U channel also has accommodation for an accessory holder for mounting lighting control louvers.

Premolded outer subpanel U channels are fastened to the four remaining panel ends. Each U channel includes a receiver channel designed to receive the piston arm of a retention hinge. It is sized so as to allow the piston arm to move freely with minimal friction.

A high-tension hinge retainer is made from a hinge mechanism that is commonly used by laptop computer manufacturers. This hinge mechanism is molded into two plastic piston arms. The arms are of two differing lengths. Each arm is designed to insert into receiver channels on the central U channel and the outer subpanel U channel. The arms include ridges or the like designed to fit snuggly into the channels yet provide minimal friction surface. The minimal friction allows free movement of the piston arms as the panels are oriented. The allowance for movement takes into account the panel displacement variances as the panels are manipulated. One of the piston arms has an oblong slot along the center. A fastening device such as a pin is inserted through the central U channel so as to capture the piston arm with a slotted end. The pin is removable to allow for replacement of the retainer hinge.

BRIEF DESCRIPTION OF THE INVENTION

FIGS. **4*a*-4*e*** are detailed perspective views of the premolded retainer hinge.

Figure 5:
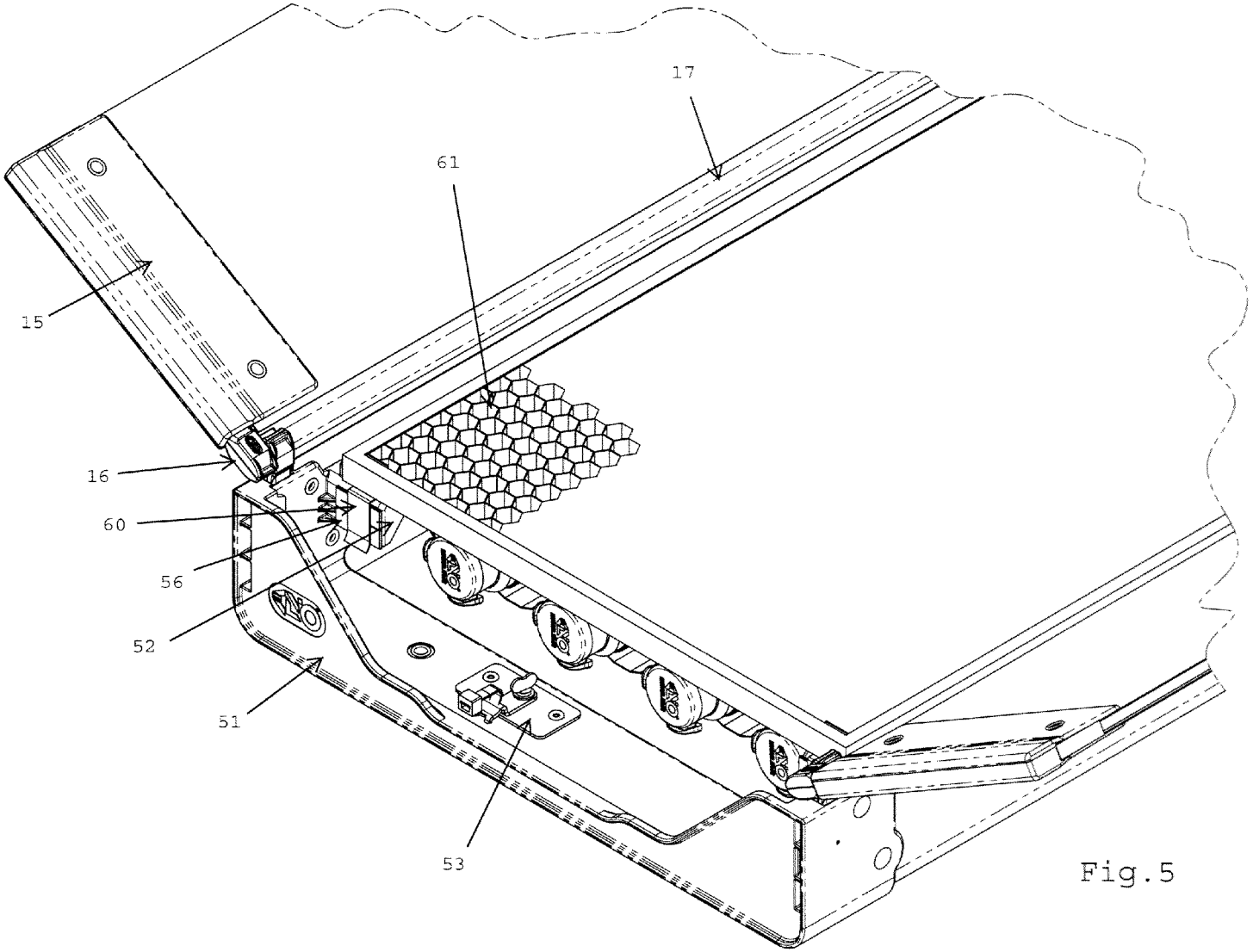

FIG. 5 is a perspective view of a honeycomb light louver resting upon an accessory platform.

Figure 6:
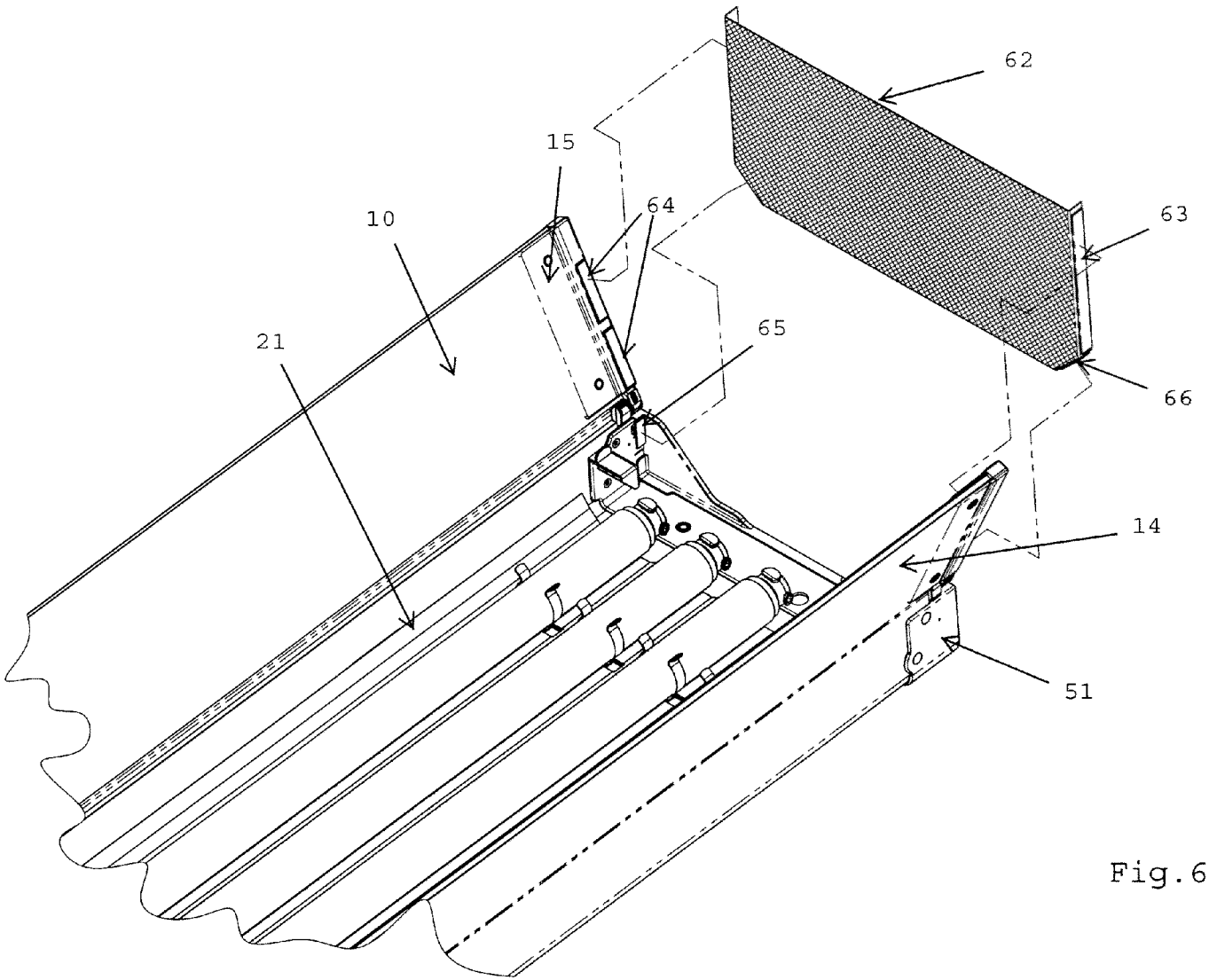

FIG. 6 is a partial perspective view of the fixture with a flexible and expandable opaque cloth light shield applied to the outside panels.

Figure 7:
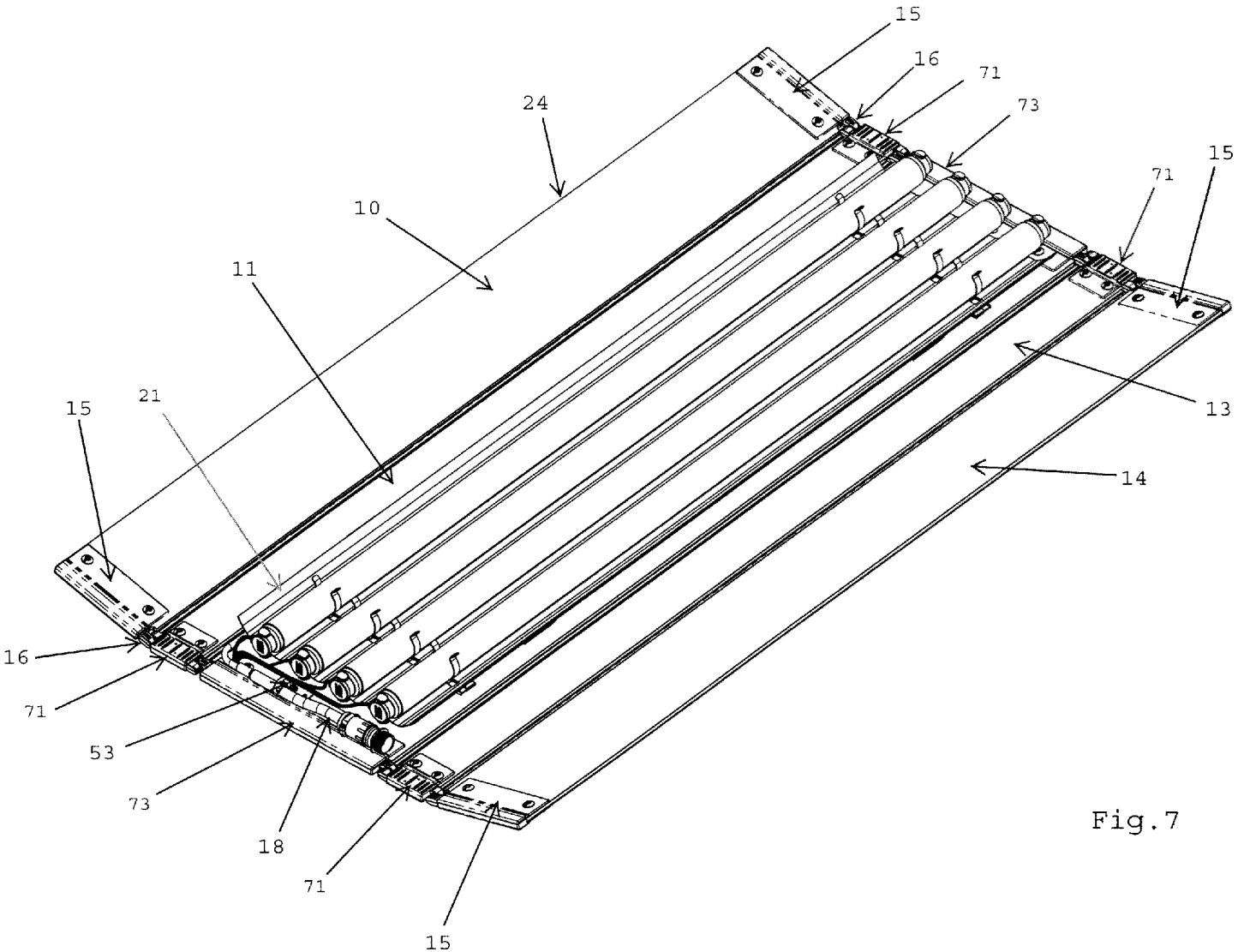

FIG. 7 is a perspective view of the front of a fluorescent lighting system in accordance with an alternate embodiment of the invention.

Figure 8:
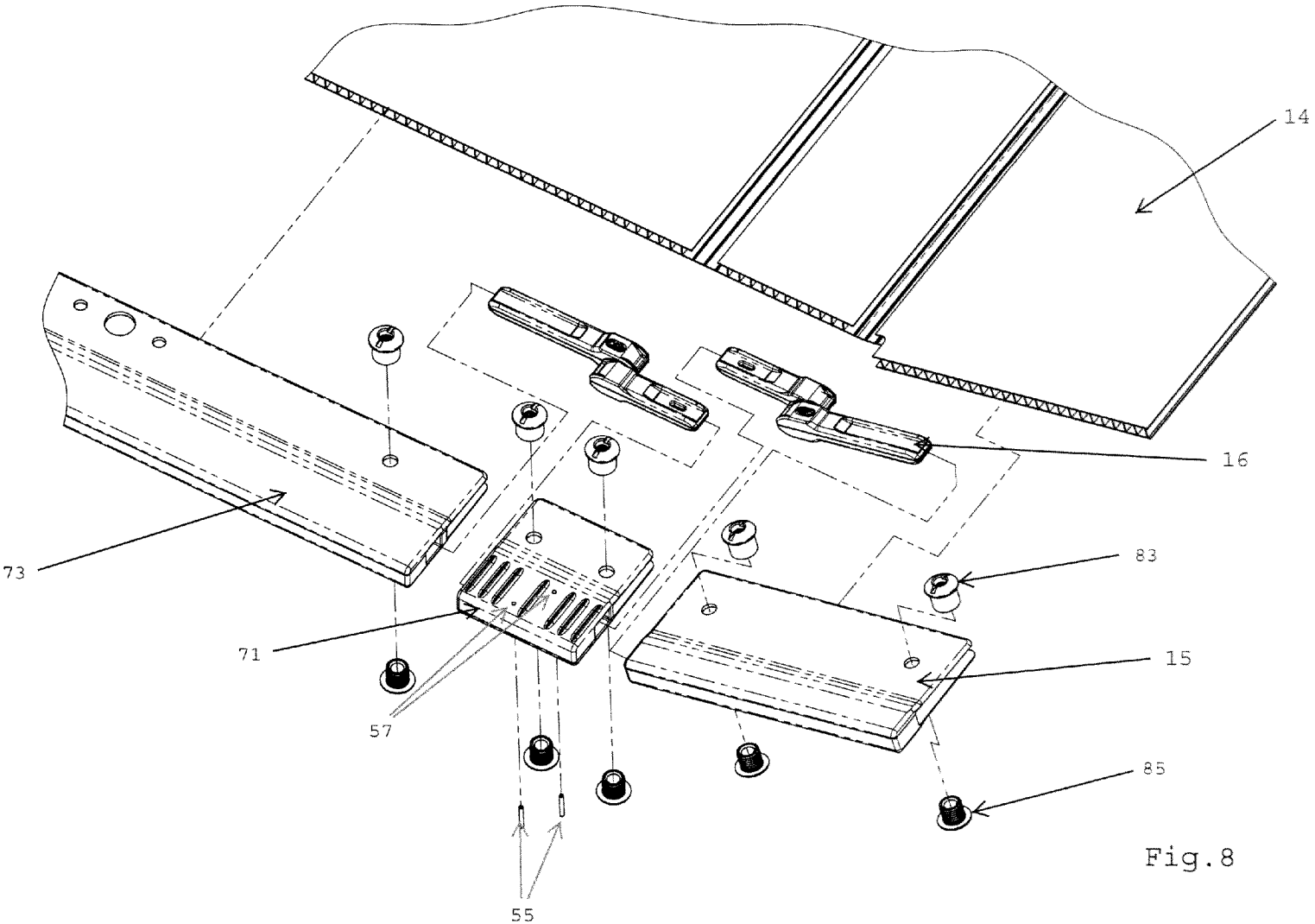

FIG. 8 is an exploded view of the premolded outer subpanel U channel, the premolded retainer hinges, the premolded inner subpanel U channel and the premolded central U channel form for the FIG. 7 embodiment.

Figure 9:
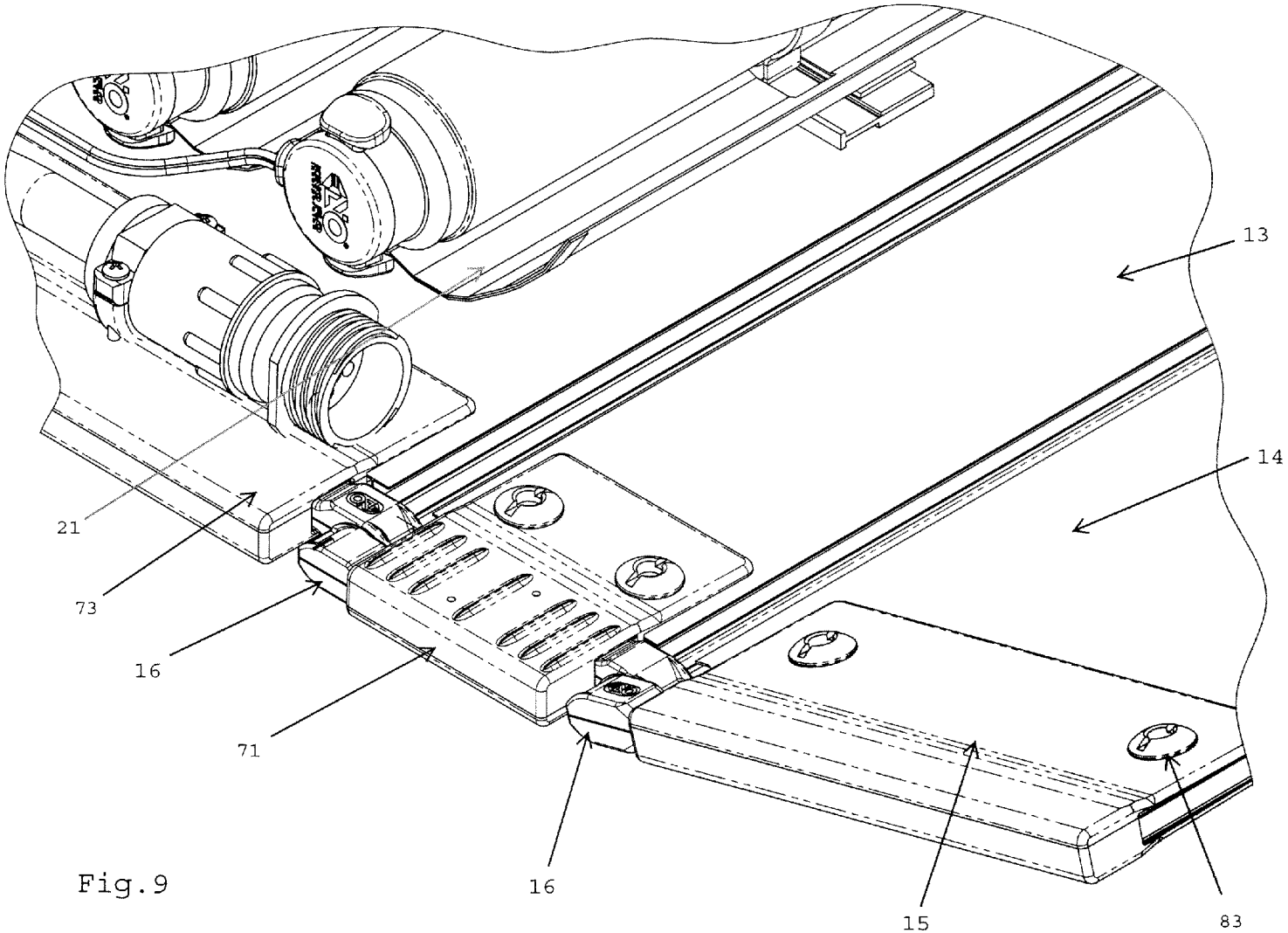

FIG. 9 is a detailed perspective view of the three U channel forms as used in the FIG. 7 embodiment.

DETAILED DESCRIPTION OF THE INVENTION

Figure 1:
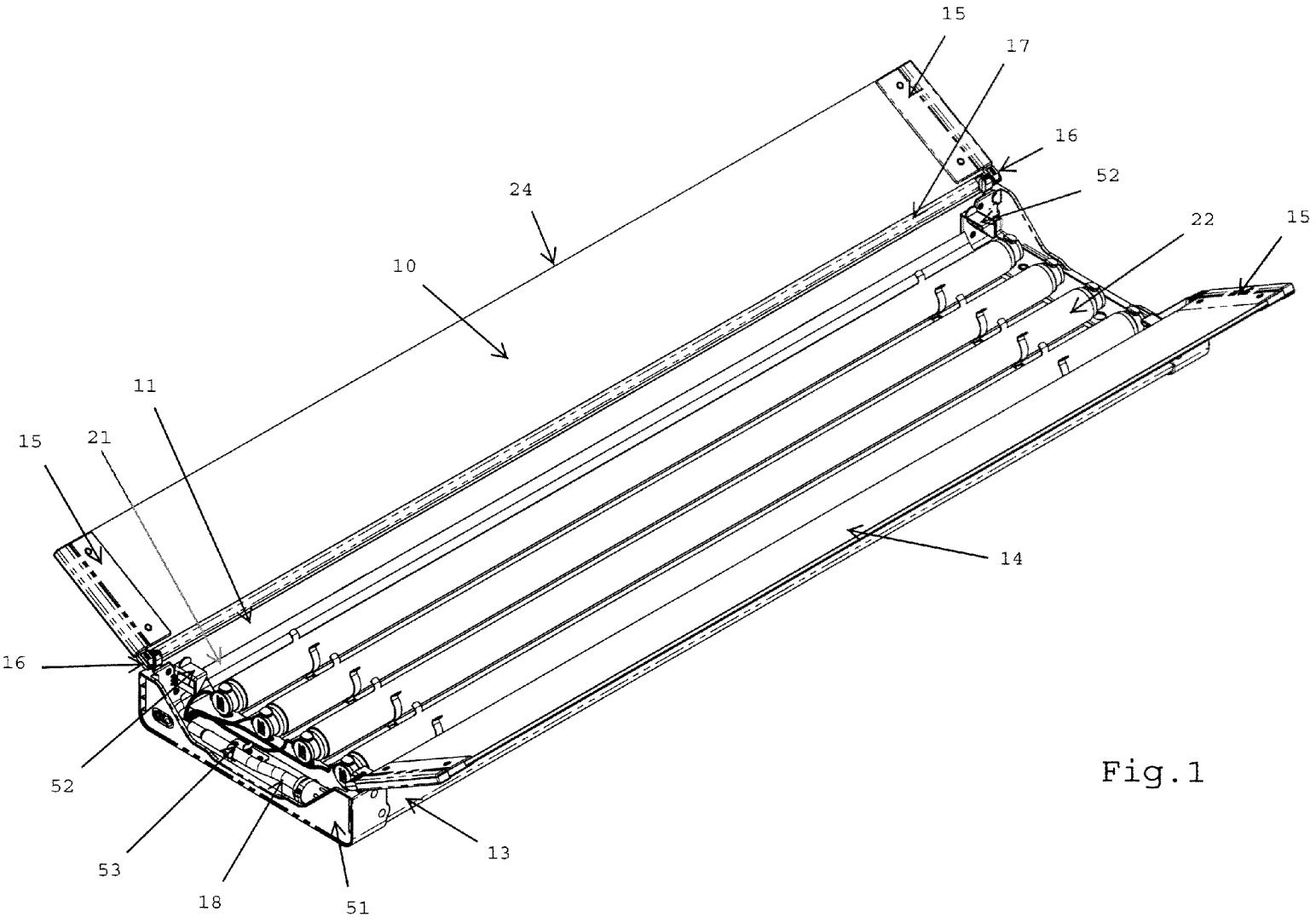
FIG. 1 is a perspective view of the front of a fluorescent lighting system in accordance with the invention.
Figure 2:
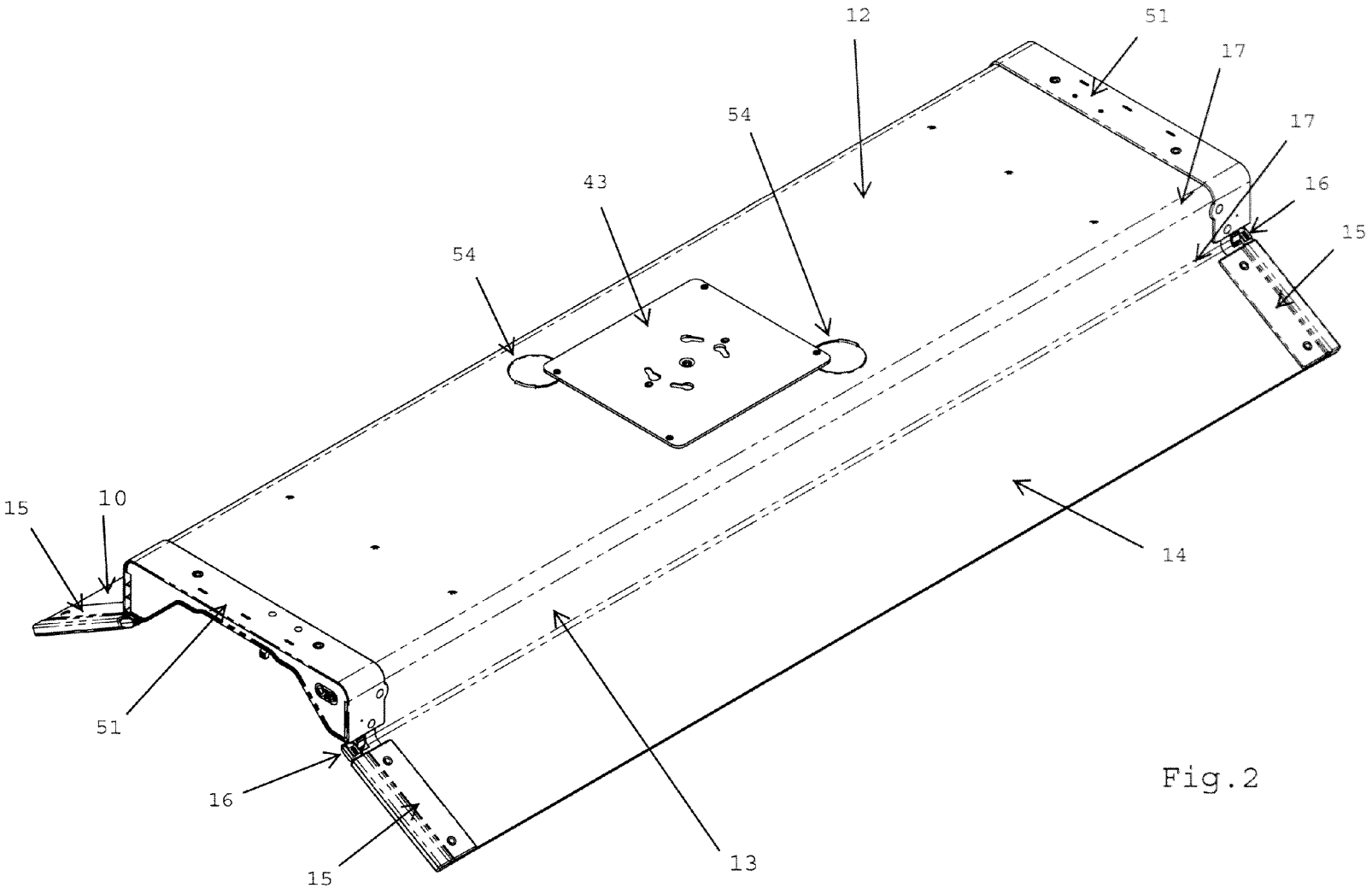
FIG. 2 is a perspective view of the rear view of the fluorescent fixture.

Referring to the figures in detail, FIGS. 1 and 2 are perspective views of the present invention. The invention comprises an elongated corrugated plastic panel 24 made into five subpanels by removing three flutes 17 (only one is shown) of the corrugation out to provide for hinging. The panel 24 includes center panel 12 at the center of said panel, a pair of inner subpanels 11 and 13 each on one side of center subpanel 12, outer subpanel 10 positioned on the outer side of inner subpanel 11, and outer subpanel 14 positioned on outer side of inner subpanel 13. All subpanels 10, 11, 13 and 14 are symmetrically positioned and longitudinally extending in parallel to center subpanel 12. Removal of two flutes 17 at each juncture of subpanels 10/11 and 13/14 provide for convenient and flexible hinging of subpanels without adding extra weight. The center panel may be reflective or an aluminum or other reflective material 21 may be placed under the lamps.

In order to prevent the subpanels from reverting back to their original positions after being flexed to a desired configuration, at each end of each outer subpanel 10 and 14, a premolded U channel 15 in the shape of a rectangle is attached therein so that a one end of a flexible high tension hinge 16 having a substantially rectangular cross section may be easily inserted. The other end of the hinge 16 is inserted into the premolded central U channel 51. Since hinge 16 is flexible, each subpanel can be manually positioned and held by the hinge in said position.

In the preferred embodiment, center subpanel 12 is always twice the width of the outer subpanels 10 and 14. The fluorescent lighting source 22 is placed on the center subpanel 12. Inner subpanels 11 and 13 and outer subpanels 10 and 14 are used to control the direction of and limit the output of the fluorescent lighting source 22. Premolded center U channel 52 includes accessory platform and a ¼ turn lamp harness strain relief socket 53 that secures the lamp harness cord 18.

FIG. 2 is a perspective view of the back of the fixture. A mating plate 43 is centrally located on the back of the fixture. The mating plate interfaces with mounting hardware allowing the fixture to be applied to an industry standard lighting stand. Two fixture strain relief loops 54 consisting of a high tensile strength aircraft wire are located at opposite corners positioned under the mating plate.

Figure 3:
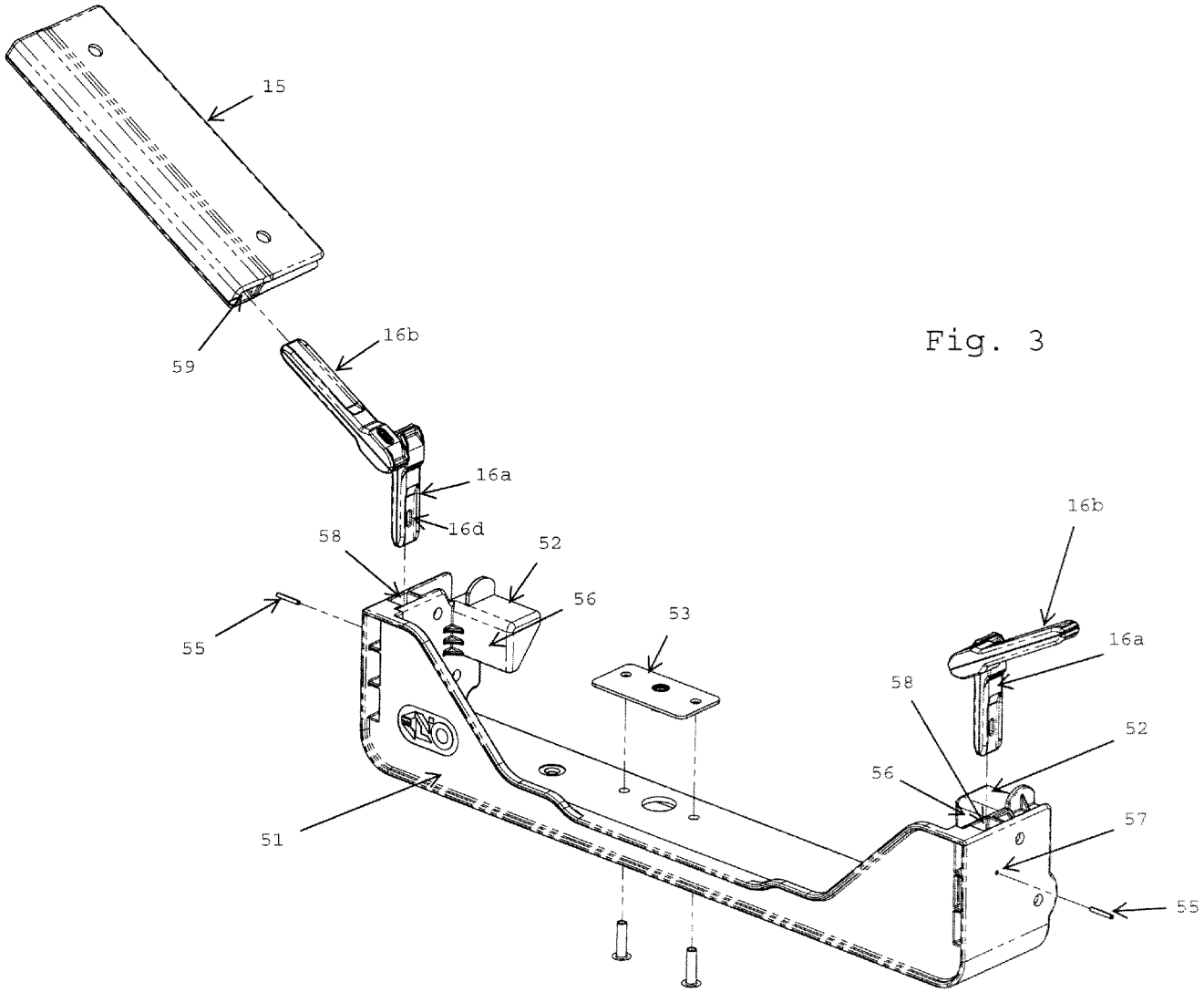
FIG. 3 is an exploded view of the premolded outer subpanel U channel, the premolded retainer hinges and the premolded central U channel form.
Figure 4C:
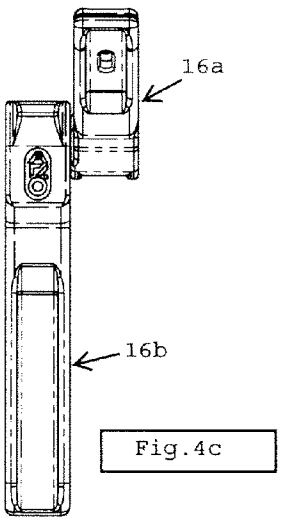
Figure 4B:
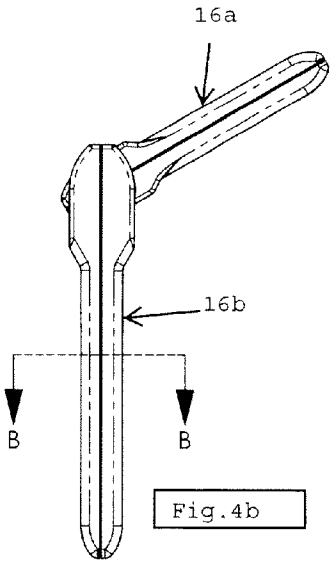
Figure 4E:
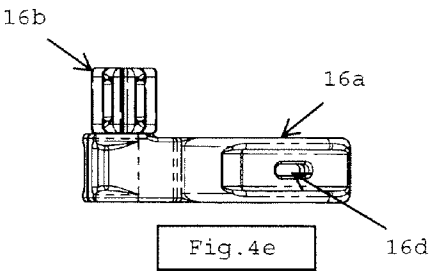
Figure 4A:
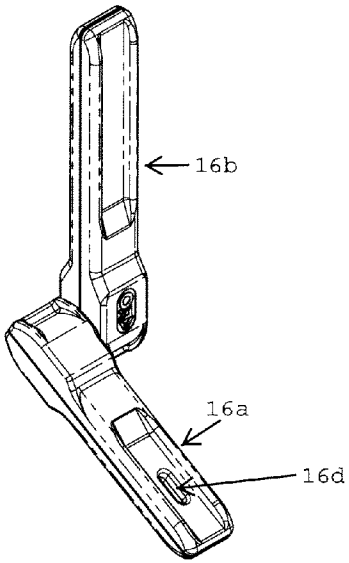
Figure 4D:
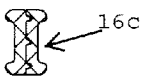

FIG. 3 is an exploded assembly perspective view of the two premolded U channel openings 58 and 59 and the retainer hinge 16. The short piston leg 16*a* of the retainer hinge 16 is inserted to receiver channel opening 58 and secured by a fastener pin 55 inserted through a hole 57 on the central U channel 51. The long piston leg 16*b* is inserted into receiver channel opening 59. This is done by folding subpanels 10 and 14 back so they are substantially parallel to inner subpanels 11 and 13. In this position, piston legs 16*a* and 16*b* can be inserted into receiver channels 58 and 59 simultaneously. The removable pin fastener 55 in the central U channel 51 allows for easy removal and replacement of hinge 16 such that in cases of damage or hinge fatigue, resulting in loss of tension, a new hinge can be inserted without having to replace the complete hinging assembly or the lighting system itself. This assembly is mirrored on the remaining four corners of the fixture. Retainer hinge piston 16*b* is inserted into receiver channel 59 on outer subpanel U channel 15. This assembly is mirrored on the remaining ends of the two outer subpanels 10. The quarter turn lamp harness strain relief socket 53 is applied to central panel U channel 51. This central U channel 51 is also applied to the opposite end of the fixture without inclusion of the strain relief socket 53.

The U channels are affixed to their respective subpanels by suitable nuts and bolts, rivets or other fasteners known in the art (not shown in FIG. 3 but see FIG. 7 for an embodiment in which barrel nuts and bolts are used).

In FIGS. 4*a*-4*e*, a series of perspective and cross sectional views of the retainer hinge 16 having a short piston 16*a* and a long piston 16*b* are shown. The short piston 16*a* has an oblong hole 16*d* for the fastening device. In this manner, slight adjustments can be made to the position of the short piston 16*a* within channel 58 while keeping the short piston within the channel. This movement is necessary to accommodate the off center pivot point of the living hinges 17. The long piston may also be adjusted within channel 59, but due to its longer length, a fastening device as used for the short piston is not needed. Both pistons display cross section 16*c* that ensures movement within the channels 59 and 58 with a minimum of friction.

FIG. 5 is a perspective view of the honeycomb light louver 61 resting upon the accessory platform 52. A hook and loop fastener tab 60 is fastened to the frame of the light louver 61. The fastener tab 60 adheres to its hook and loop opposite 56 that is adhered to the side of the accessory platform 52. The light louver 61 has the hook and loop attachment mechanism recurrent on the remaining three corners.

FIG. 6 is a partial perspective view of the fixture and a flexible and expandable opaque cloth light shield 62 applied to the outside panels. A hook and loop fastener 64 is applied to the outside U channel 15 on both outside panels 10 and 14. Another hook and loop fastener 65 is applied to the central U channel 51. The mating hook and loop 63 and 66 is applied to the outside edges of the light shield 62. The light shield 62 is applied in the same fashion at the other end of the fixture.

An alternate embodiment of the invention is illustrated in FIGS. 7-9. As shown in FIG. 7, instead of central U channel pairs 51, U channel pairs 71 and 73 may be added to the ends of center panel 12 and inner subpanels 11 and 13. As compared to the first embodiment shown for example in FIG. 2, inner subpanels 11 (not shown in FIG. 2) and 13 instead of being in a fixed position relative to center panel 12, in the FIGS. 7-9 embodiment, inner subpanels 11 and 13 may also be adjusted around a hinge formed between inner panel 11/center panel 12, and inner panel 13/center panel 12.

In particular, in place of central U channel 51, U channel 73 is attached to each end of center panel 12. U channel 71 is added to each end of inner subpanel 11 and inner subpanel 13. U channels 73 and 71 are configured the same as sub channels 51 and 15. That is, each U channel is placed over an end of its corresponding panel, and a flexible high-tension hinge 16 is inserted into openings in each of the U channels 73 and 71 as described above with respect to the insertion of hinge 16 with reference to FIG. 3. Once the U channels and corresponding hinges are installed, the resulting hinges formed between center panel 12, and inner subpanels 11 and 13 on the one hand, and the hinge formed between each inner and outer subpanel 10/11 and 13/14 may be adjusted to be in a desired position. The adjustment may be between zero and approximately 90 degrees by the hinges formed between center panel 12, and inner subpanels 11 and 13, and between approximately zero degrees and 135 degrees by the hinges found between inner/outer subpanels 10 and 11, and 13/14.

Each of the U channels may be secured by the use of slotted barrel nuts 83 and barrel bolts 85. In this manner, in addition to securing the U channels to its respective panel, since the barrel nuts and barrel bolts have an open central bore, each nut/bolt pair may be used as a screw point to secure the fixture to a wall when the fixture is used in a studio or on location. The barrel inside diameter should be sufficient to allow, for example, a drywall screw to be inserted so that the panel may be secured to a wall. When such drywall screws are removed, then the fixture may be moved, closed for transport, and be available for subsequent use. Additionally, the barrel nut/bolts allow for easy removal of each of the U channels for replacement or repair of a damaged U channel or hinge.

The foregoing description is intended to provide a detailed explanation how to make and use the invention. However, such description is not intended to limit the scope of the invention as defined in the following claims.

We claim:

1. A portable fluorescent lighting system comprising:

a) an elongated corrugated panel for holding fluorescent light sources, said panel including a center subpanel, a pair of inner subpanels, each adjacent to opposite sides of said center subpanel and a pair of outer subpanels, each outer subpanel adjacent to a corresponding one of said inner subpanels;

b) a first U channel coupled to said center subpanel and said inner subpanels at one end thereof;

c) a second U channel coupled to said center subpanel and said inner subpanels at a second end thereof, said first and second U channels configured to engage said ends of said center subpanel and said pair of inner subpanels;

d) a first pair of U channels coupled to opposite ends of a first one of said outer subpanels;

e) a second pair of U channels coupled to opposite ends of a second one of said outer subpanels;

f) a first pair of retention hinges coupled to said first U channel and said first pair of U channels;

g) a second pair of retention hinges coupled to said second U channel and said second pair of U channels.

2. The portable fluorescent lighting system defined by claim 1 wherein each of said hinges includes a first leg and a second leg, said first leg configured to be insertable into a mating receiver channel of a corresponding one of said first and second U channels, said second leg configured to be insertable into a mating receiver channel of a corresponding one of said first pair and second pair of U channels.

3. The portable fluorescent lighting system defined by claim 1 wherein each of said hinges operates to maintain said outer subpanels in one of a closed position, an open position and a position between said open and closed positions.

4. The portable fluorescent lighting system defined by claim 1 wherein said elongated corrugated panel comprises a polypropylene plastic.

5. The portable fluorescent lighting system defined by claim 1 wherein said first and second U channels each include an accessory platform at each end thereof.

6. The portable fluorescent lighting system defined by claim 5 further comprising a light louver attachable to said accessory platforms via hook and loop fasteners affixed to said accessory platforms.

7. The portable fluorescent lighting system defined by claim 1 further comprising an opaque cloth light shield affixed to said first and second U channels and said first and second pair of U channels via hook and loop fasteners.

8. A portable fluorescent lighting system comprising:

a) an elongated corrugated panel for holding fluorescent light sources, said panel including a center subpanel, a pair of inner subpanels, each adjacent to opposite sides of said center subpanel and a pair of outer subpanels, each outer subpanel adjacent to a corresponding one of said inner subpanels;

b) a first pair of U channels coupled to opposite ends of said center subpanel;

c) a second pair of U channels coupled to opposite ends of a first one of said inner subpanels;

d) a third pair of U channels coupled to opposite ends of a second one of said inner subpanels;

e) a fourth pair of U channels coupled to opposite ends of a first one of said outer subpanels;

f) a fifth pair of U channels coupled to opposite ends of a second one of said outer subpanels;

g) a first set of four retention hinges coupled to said first pair of U channels and said second pair of U channels and said third pair of U channels;

h) a second set of four retention hinges coupled to said fourth pair of U channels and said fifth pair of U channels.

* * * * *